United States Patent [19]

Saito

[11] Patent Number: 5,027,619

[45] Date of Patent: Jul. 2, 1991

[54] KNITTING NEEDLE DRIVING MECHANISM OF KNITTING MACHINE

[75] Inventor: Sadao Saito, Fujimi, Japan

[73] Assignee: WAC Data Services Co. Ltd., Fujimi, Japan

[21] Appl. No.: 416,950

[22] Filed: Oct. 4, 1989

[30] Foreign Application Priority Data

Oct. 5, 1988 [JP] Japan ..... 63-249967

[51] Int. Cl.[5] ..... D04B 15/78

[52] U.S. Cl. ..... 66/218; 66/220

[58] Field of Search ..... 66/218, 220, 221

[56] References Cited

U.S. PATENT DOCUMENTS

| | | | |
|---|---|---|---|
| 3,908,403 | 9/1975 | Ringrose | 66/221 |
| 3,948,062 | 4/1976 | Sumitomo | 66/220 |
| 3,961,501 | 6/1976 | Martinetz | 66/218 |
| 3,974,664 | 8/1976 | Erb | 66/218 |
| 3,990,270 | 11/1976 | Paepke | 66/221 |
| 4,471,636 | 9/1984 | Lonati | 66/221 |
| 4,708,002 | 11/1987 | Lonati | 66/218 |

FOREIGN PATENT DOCUMENTS

| | | | |
|---|---|---|---|
| 1957400 | 7/1971 | Fed. Rep. of Germany | 66/221 |
| 0210790 | 2/1987 | Japan | 66/218 |
| 466888 | 2/1969 | Switzerland | 66/218 |

*Primary Examiner*—Werner H. Schroeder
*Assistant Examiner*—John J. Calvert
*Attorney, Agent, or Firm*—Kenyon & Kenyon

[57] ABSTRACT

Disclosed is a knitting needle driving mechanism of a jacquard knitting machine for driving knitting needles by using piezo-electric elements in which a rear end portion of a piezo-electric body is movably supported in a groove of a supporting body or a housing, a front end portion of the piezo-electric body is movably connected to a rear end portion of a finger which is arranged so as to be aligned with the piezo-electric body and supported at the rear end portion thereof by the supporting body or the housing, and an intermediate portion between the front end portion and the rear end portion of the piezo-electric body is inserted into a rotatable member rotatably mounted on the supporting body or the housing. This knitting needle driving mechanism is small in size, high in response speed and prolonged in lifetime.

4 Claims, 11 Drawing Sheets

KNITTING NEEDLE DRIVING MECHANISM OF KNITTING MACHINE

BACKGROUND OF THE INVENTION

The present invention relates to a knitting needle driving mechanism of a knitting machine, more particularly to a knitting needle driving mechanism for driving a knitting needle by using one or more piezo-electric elements.

In a jacquard knitting machine such as a jacquard circular knitting machine, a jacquard flat knitting machine or the like, there has heretofore been used a knitting needle driving mechanism for transmitting a patterning procedure memorized in a memory such as a pin drum, a tape, a floppy disk or the like to an up-and-down movement of the knitting needle. For example, there has been known the knitting needle driving mechanism as illustrated in FIG. 21, a main portion of which comprises a plurality of fingers 50 arranged in parallel to one another. In this kind of knitting needle driving mechanism, the finger 50 slides by signals supplied from the memory to allow a jack 51 engaging with a lower end of the knitting needle to move toward a center of a knitting cylinder 52, whereby a cam butt 53 on a lower portion of the jack 51 disengages from a rising cam 54.

On the other hand, a high-speed jacquard knitting machine has recently been desired. In order to cope with such a high-speed knitting machine, it is also necessary to speed up the response of the knitting needle driving mechanism. However, the knitting needle driving mechanism constituted so as to slide the fingers as described above has a limit to an increase in response speed or in sliding speed of the fingers. It is possible to obtain a high-speed knitting machine by increasing the number of the fingers without an increase in response speed. However, the increased number of the fingers results in a large-sized knitting needle driving mechanism, and causes the difficulty of arranging the knitting needle driving mechanism in a narrow space.

In the meantime, the same applicant as that of the present invention proposed a knitting needle driving mechanism comprising a plurality of swingable fingers in Japanese Patent Unexamined Publication No. 60-22485/1985, entitled "Knitting Needle Driving Mechanism of Circular Knitting Machine". This knitting needle driving mechanism can achieve a rapid response speed compared to conventional ones having the sliding-type fingers in wide use, and therefore can easily cope with the high-speed knitting machines. Further, this also serves to miniaturize the knitting needle driving mechanism and to decrease the power consumption thereof.

However, in the knitting needle driving mechanisms having the above sliding-type and swing-type fingers, the fingers are slid or swung by utilizing an attraction force and a repelling force from an electromagnet. Namely, the fingers are slid or swung by applying an electric current to both the poles of the electromagnet in such a manner that the poles of the electromagnet are changed from plus to minus, respectively, or vice versa. Therefore, the response speed of the knitting needle driving mechanism activated by the electromagnet has a limit caused by a function of the electromagnet itself, and an optimum high speed of the electromagnet is around 80 cycles per second. On the other hand, the power consumption efficiency of the electromagnet is about 1% and the remainder of the electric current is consumed as heat or the like, and hence there is the problem in that the total consumption of the electric power is extremely high when the knitting needle driving mechanism having the electromagnet is used.

Consequently, this kind of knitting needle driving mechanism can not be used for, for example, a circular knitting machine for knitting pantyhose having 240 knitting needles and a rotational speed of 220 rpm. Accordingly, in the existing circumstances, the rotational speed of the circular knitting machine is decreased to a speed corresponding to an ordinary response speed of the conventional knitting needle driving mechanism, when pantyhose are knitted.

Then, the same applicant as that of the present invention proposed a piezo-electric knitting needle driving mechanism in which a needle is driven by bending a finger by means of piezo-electric elements, in place of the above knitting needle driving mechanism of the knitting machine using the electromagnet (Japanese Patent Unexamined Publication No. 62-28451/1987).

As illustrated in FIGS. 14 an 15, the finger 21 of the knitting needle driving mechanism comprises a plate 24 having an attaching portion 22 for attaching the finger to a housing, at an end of the plate, a guiding portion 23 engaging with a finger butt of a knitting needle or a jack and attached to the end of the plate opposite to the attaching portion 22, and piezo-electric elements 28 and 29 attached to an upper face and an under face of the plate 24 and connected to a controller 27 (refer to FIG. 19) with lead wires 25 and 26.

As illustrated in FIG. 19, the attaching portions 22 of the fingers 21 (eight fingers are superimposed in the embodiment shown in FIG. 19) are supported in a rear wall 31 of the housing 30 of the knitting needle driving mechanism 20 and the attaching portions 22 serve as fulcrums of the bending motion of the fingers 21.

Turning to FIG. 19, the reference numerals 32, 33 and 34 designate a front wall of the housing 30, an upper wall thereof and a lower wall thereof, respectively. As shown in FIG. 20, the front wall 32 of the housing 30 is provided with an opening 35 for allowing the guiding portions 23 of the fingers 21 to protrude therethrough, and further, grooves 36 each of which has a width corresponding to a rising distance and a descending distance of the guiding portion 23.

FIG. 16 is a perspective view showing a state in which the guiding portion 23 of the finger 21 slides along the above groove 36 of the front wall 32. As shown in FIGS. 14 and 16, the guiding portion (guiding element) 23 is formed in an angled shape and attached to an end 24' of the plate 24 by means of an adhesive.

The operation of this finger 21 will hereunder be described with reference to FIGS. 17 and 18.

FIG. 17 shows a state in which a pulse is not applied to the piezo-electric element of the finger 21, and FIG. 18 shows a state in which a pulse is applied to the piezo-electric element, thereby bending the finger 21. In the state shown in FIG. 17, the finger butt 56 of the jack 51 or the knitting needle itself engages with the guiding element 23 to push the jack 51 to the right, so that a rising cam butt 53 arranged on a lower end of the jack 51 can not engage with a rising cam 54. As a result, the jack and accordingly the knitting needle engaging with an upper portion of the jack are not subjected to rising movement, which results in no formation of a knitting loop by this knitting needle. On the other hand, in the state illustrated in FIG. 18, the guiding element 23 of the finger 21 does not enter a moving path of a finger butt 56 of the jack 51 due to the bending of the finger 21, so that the jack 51 keeps its vertical position. As a result, the rising cam butt 53 of the jack 51 engages with the rising cam 54 to push the jack 51 upward, and the knitting operation is applied to the knitting needle engaging with the upper portion of the jack 51.

Thus, according to the above knitting needle driving mechanism having the fingers each using the piezo-electric elements, the piezo-electric element has a rapid response speed, and therefore it is possible to apply a pulse with high frequency to the element. For example, when a pulse of 240 cycles is applied to the element, the knitting needle can be driven at a high speed three times the speed (usually 80 cycles) of known knitting needle driving mechanisms operated by electromagnets. This means that the number of the fingers can be decreased to one-third of that of the fingers used in the known knitting needle driving mechanisms, for the knitting machines on which the same jacquard clothes are knitted. Further, if there is used this knitting needle driving mechanism which has the same number of the fingers as that of the fingers of the conventional knitting needle driving mechanisms, it is possible to knit a jacquard cloth having a pattern three times complicated in comparison to that of clothes knitted by using the conventional knitting needle driving mechanisms, namely, to knit a jacquard cloth on a knitting machine in which a product of the number of the knitting needles and a rotational speed of the knitting cylinder (in the case of a circular knitting machine) is three times that of conventional knitting machines.

The finger of this knitting needle driving mechanism is constituted by a thin plate and one or more piezo-electric elements. It is therefore possible to decrease the height necessary for arranging one finger in the driving mechanism and the width thereof, compared to the conventional fingers actuated by the electromagnets. Hence, also when the same number of the fingers are used in the knitting needle driving mechanism, the knitting needle driving mechanism itself can be further miniaturized in size. As described above, since this knitting needle driving mechanism is small in size and has a high response speed, it becomes easy to provide a jacquard knitting function also to a circular knitting machine for knitting pantyhose in which space it has previously been difficult to dispose the knitting needle driving mechanism for knitting a jacquard cloth.

As described above, however, in this knitting needle driving mechanism, the guiding portion 23 formed in an angled shape is attached to the end 24' of the plate 24, and the attaching portion 22 of the finger 21 is supported in the rear wall 31 of the housing 30. Namely, the finger 21 is cantilevered and bent as illustrated in FIG. 18. As a result, if a pulse with higher frequency is applied to the piezo-electric elements 28 and 29 to increase a response speed higher, the engagement of the jack with the butt or the like is not stabilized in some cases. Further, if the ceramic material is used to form the piezo-electric elements 28 and 29, the impact produced when the guiding portion 23 collides with the butt is transmitted to the piezo-electric elements 28 and 29 to induce strain therein, which possibly results in the damage of the piezo-electric elements 28 and 29 to reduce the lifetime thereof, because the finger 21 is cantilevered and the guiding portion 23 is bonded to the end 24' of the plate 24, in addition to the essential chipping easiness of the ceramic material.

Then, for the purpose of improving the knitting needle driving mechanism described above, the present inventor has further proposed a piezo-electric knitting needle driving mechanism in which both ends of a plate having one or more piezo-electric elements are supported in walls of a housing accommodating the knitting needle driving mechanism (Japanese Patent Application No. 63-19619/1988).

A knitting needle driving mechanism according to the invention the above-mentioned Japanese Patent Application No. 63-19619/1988 will hereunder be described with reference to FIGS. 11 to 13 in comparison to a piezo-electric knitting needle driving mechanism similar to that described above as shown in FIG. 14.

FIG. 12 is a perspective view showing a main portion of the housing of the knitting needle driving mechanism according to the present invention, and FIG. 11 is a perspective view, partly in cross section, of an embodiment of the knitting needle driving mechanism according to the present invention.

As illustrated in FIG. 12, a plurality of lateral grooves 17 for supporting plates are formed on each of inner surfaces of both side walls 16 and 16 of a plate supporting portion 15 of the housing 14. Both ends 80 and 80 of the plate 8 are inserted into the grooves 17 formed on both the walls 16 and 16, and piezo-electric elements 9 are attached to an upper face and an under face of the plate 8, thereby constituting a piezo-electric body 2, as shown in FIG. 11.

In the knitting needle driving mechanism shown in FIG. 14, the attaching portion 22 formed at an end of the plate 24 to which the piezo-electric elements 28 and 29 are attached is supported in the rear wall 31 of the housing 30 of the knitting needle driving mechanism 20 as illustrated in FIG. 19, and serves as a fulcrum of the bending motion of the finger 21. Namely, the finger 21 is supported in a cantilever form and bent in this cantilever form.

In contrast, in the knitting needle driving mechanism shown in FIG. 11, both the ends 80 and 80 of the plate 8 to which the piezo-electric elements 9 are attached is supported by the plate supporting portions 15 in the housing 14 of the knitting needle driving mechanism, not in the cantilever form. In both cases, when a pulse is applied to the piezo-electric element, a piezo-electric phenomenon occurs on the piezo-electric element, and mechanical strain causes mechanical vibration of the plate, thereby bending the plate.

In the former, the bending is carried out in the cantilever form. However, in the latter, the bending is achieved in the form in which both the ends of the plate are supported. The latter can therefore attain the stabilized bending motion even on application of a pulse with high frequency and the improvement of the response speed. Further, the piezo-electric elements 9 bonded to the plate 8 are difficult to be broken, and hence their lifetime is prolonged.

Furthermore, in the knitting needle driving mechanism illustrated in FIG. 14, the guiding portion 23 engaging with the butt of the knitting needle or the jack is attached to the end 24' of the plate 23.

In contrast, in the knitting needle driving mechanism shown in FIG. 11, a finger 5 is mounted not on the plate 8, but on the piezo-electric element 9. Namely, a rear end portion 5A of the strip-like finger 5 is mounted on a center of an upper face of the piezo-electric element 9 so that the finger 5 is arranged about perpendicularly to the longitudinal axis of the plate 8. A back face of the rear end portion 5A of the finger 5 is bonded to the upper face of the piezo-electric element 9 through an elastic member 10. Accordingly, the mechanical vibration or the movement of the plate 8 is well transmitted to the finger 5, and the impact produced when a front end portion 5B of the finger 5 engages with the butt of the jack or the like is decreased, thereby being capable of cushioning external strain imparted to the piezo-electric element 9. Also, the finger 5 is easily detached from the plate 8 and replaced with a new one.

In addition, in the knitting needle driving mechanism shown in FIG. 11, a fulcrum portion 5C of the bending motion of the finger 5 is fixed to a finger fixing portion 18, and a fixing portion 180 serves as a fulcrum of the bending motion of the finger 5. The finger fixing portion 18 is vertically installed adjacent to a plate supporting portion 15 of a housing 14, as illustrated in FIG. 12. As shown in FIG. 13, the finger 5 is provided with a hole in the crosswise direction of the finger 5, and each of right and left end walls 18A and 18B of the finger fixing portion 18 are also provided with a hole. A shaft 6 is inserted into the hole of the finger 5, and both ends of the shaft 6 are fitted into the holes of the right and left end walls 18A and 18B, respectively. Then, screws 7 and 7 are threaded in from both the ends of the shaft 6 to fix the shaft 6 to the end walls 18A and 18B.

Consequently, when the movement of the piezo-electric element 9 attached to the plate 8 is transmitted to the above fulcrum 180 through the rear end portion 5A attached to the piezo-electric element 9 of the finger 5, it is required to amplify that movement. For this reason, an amplifying portion 5D for amplifying the movement of the finger 5 is provided, elongating from the fulcrum 180 to the front end portion 5B of the finger 5, thereby forming the finger 5 longer. There can be achieved the effect that the impact is cushioned by the middle portion of the finger 5 due to the long finger when the front end portion 5B of the finger 5 engages with the butt of the jack or the like. Further, since the finger 5 is thus fixed to the finger fixing portion 18, the impact produced when the front end portion 5B of the finger 5 engages with the jack 51 does not reach the piezo-electric element, which results in the difficulty in damage of the piezo-electric element. The lifetime thereof can therefore be prolonged.

However, in the knitting needle driving mechanism shown in FIG. 11, the finger 5 is attached perpendicularly to the longitudinal axis of the piezo-electric body 2 composed of the plate 8 and the piezo-electric elements 9, so that the piezo-electric body 2 is increased in width and the plate supporting portion 15 of the housing 14 is required to be also increased in width, which results in a large-sized knitting needle driving mechanism and causes the difficulty of arranging the knitting needle driving mechanisms in a narrow space for certain kinds of knitting machines. As described above with respect to FIG. 12, several knitting needle driving mechanisms are arranged around a knitting cylinder. The number of knittings accompanied by the rotation of the knitting cylinder and the knitting speed depend upon the number of the knitting needle driving mechanisms arranged. Hence, the miniaturization of the knitting needle driving mechanism is an important problem.

Further, in the knitting needle driving mechanism shown in FIG. 11, the rear end portion 5A of the finger 5 is attached to the surface of the piezo-electric element 9 bonded to the plate 8 in such a manner that the finger 5 is overlapped on the piezo-electric body composed of the plate 8 and the piezo-electric element 9 bonded thereto. This causes the knitting needle driving mechanism to increase in size in the direction of the height of the housing, when the knitting needle driving mechanism is accommodated in the housing 14. In addition, the rear end portion 5A of the finger 5 is attached to the surface of the piezo-electric element 9 through the elastic material 10, so that the knitting needle driving mechanism is further increased in size and the clearance between the fingers 5 is enlarged when a large number of plates and fingers are accommodated in the housing.

Furthermore, in the knitting needle driving mechanism described above, the load of the finger 5 is liable to fall on the piezo-eletric element 9 due to the attachment of the finger 5 to the surface of the piezo-eletric element 9, though the finger 5 is fixed by the finger fixing portion 18. Hence, when voltage is applied to the piezo-eletric element 9 to achieve the bending motion, the bending motion may be disturbed and there is the possibility that the piezo-electric element 9 is broken at its attached position in long-term use.

Moreover, in the knitting needle driving mechanism described above, the finger 5 is provided with the amplifying portion 5D, thereby forming the finger longer, and the elastic material 10 is disposed between the piezo-electric element 9 and the finger 5, for cushioning the impact produced when the front end portion 5B of the finger 5 engages with the butt or the like. In this case, the torque developed when the front end portion 5B of the finger 5 engages with the butt or the like to drive the knitting needle can not but be reduced, and the elastic material is easily deteriorated because of being formed of elastic rubber.

SUMMARY OF THE INVENTION

It is therefore an object of the present invention to provide a knitting needle driving mechanism which can eliminate the above disadvantages of the prior-art knitting needle driving mechanisms, making use of the advantages of the piezo-electric knitting needle driving mechanisms which is high in response speed, low in power consumption and small in size, compared to the knitting needle driving mechanisms activated by the electromagnets.

Other objects and novel features of the invention will become apparent from the following specification and the accompanying drawings.

The present inventor proposed a knitting needle driving mechanism shown in FIGS. 10A and 10B (cross sectional view of FIG. 10A) in the course of completing this invention. In this mechanism, a rear end portion of a piezo-electric body 2 composed of a plate 8 and a piezo-electric element 9 bonded thereto is inserted into a groove of a supporting body A, whereas a front end portion of the piezo-electric body 2 is inserted into a rear end portion of a finger 5. Hence, the bending motion of the piezo-electric body 2 is easily performed. Further, the piezo-electric body 2 and the finger 5 are arranged in alignment (in the same direction), so that the knitting needle driving mechanism is miniaturized in width and also in height.

When various tests were conducted, using this knitting needle driving mechanism, by applying voltage to the piezo-electric element 9 of the piezo-electric body 2 through lead wires 12, the surface of the piezo-electric element 9 of the piezo-electric body 2 was incidentally pressed with a finger, whereupon it was discovered that the operation speed of the finger 5 was remarkably improved and the torque of the front end of the finger 5 was increased.

The present invention has been completed, based on such information, wherein a piezo-electric body is formed so as to make the bending motion as easy as possible, provided an intermediate fulcrum is provided between a front end portion and a rear end portion of the piezo-electric body as shown in FIG. 10B, and the piezo-electric body and a finger are arranged in alignment, thereby being capable of providing a knitting needle driving mechanism significantly excellent in comparison to prior-art piezo-electric knitting needle driving mechanisms.

According to the present invention, there is provided a knitting needle driving mechanism for a knitting machine having a piezo-electric body composed of a plate and a piezo-electric element bonded thereto and a finger attached to said piezo-electric body, in which it is enabled to knit a predetermined pattern by applying voltage to said piezo-electric element to actuate said finger and thereby driving a knitting needle of the knitting machine, characterized in that a rear end portion of said piezo-electric body is movably supported in a groove of a supporting body or a housing, a front end portion of said piezo-electric body is movably connected to a rear end portion of said finger which is arranged so as to be aligned with said piezo-electric body and supported at the rear end portion thereof by the supporting body or the housing, and an intermediate portion between the front end portion and the rear end portion of the piezo-electric body is inserted into a rotatable member rotatably mounted on the supporting body or the housing.

The knitting needle driving mechanism of the present invention is so constituted that the front end portion, the rear end portion and the intermediate portion of the piezo-electric body do not prevent the bending motion of the piezo-electric body. As a result, the piezo-electric element of the piezo-electric body can be prolonged in lifetime.

The bending motion of the piezo-electric body can be freely performed and an intermediate fulcrum is mounted, thereby being capable of improving the needle driving speed remarkably.

Further, in the knitting needle driving mechanism of the present invention, the length of the finger is shortened in comparison to that in a prior-art knitting needle driving mechanism. The finger can be decreased in weight and increased in response speed by shortening the length of the finger. However, there is the disadvantage of being liable to bound on engagement with the butt or the like. In accordance with the present invention, there can be provided a knitting needle driving mechanism in which the response speed is improved and the finger is difficult to bound, even though the finger is shortened.

In the present invention, the finger is connected to the rear end of the piezo-electric body in alignment and the rear end portion of the finger is fixed to the supporting body or the housing. Hence, the impact produced when the front end portion of the finger engages with the butt or the like is cushioned not to be transmitted to the piezo-electric element, which causes the lifetime of the piezo-electric element to be prolonged.

Furthermore, the knitting needle driving mechanism can be miniaturized in width and in length by connecting the piezo-electric element to the finger in alignment. Accordingly, there can be provided a very compact knitting needle driving mechanism compared to prior-art knitting needle driving mechanisms.

DESCRIPTION OF THE PREFERRED EMBODIMENTS

The present invention will hereinafter be described with reference to the accompanying drawings.

Figure 1:
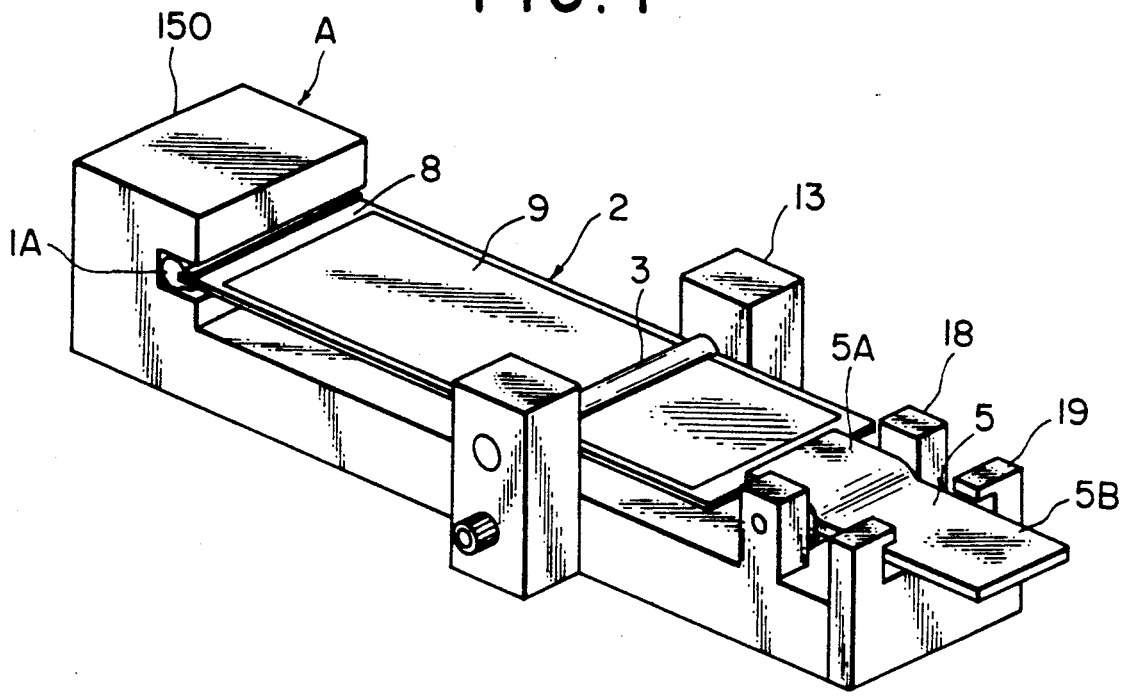
FIG. 1 is a perspective view showing a knitting needle driving mechanism embodying the present invention.
Figure 2:
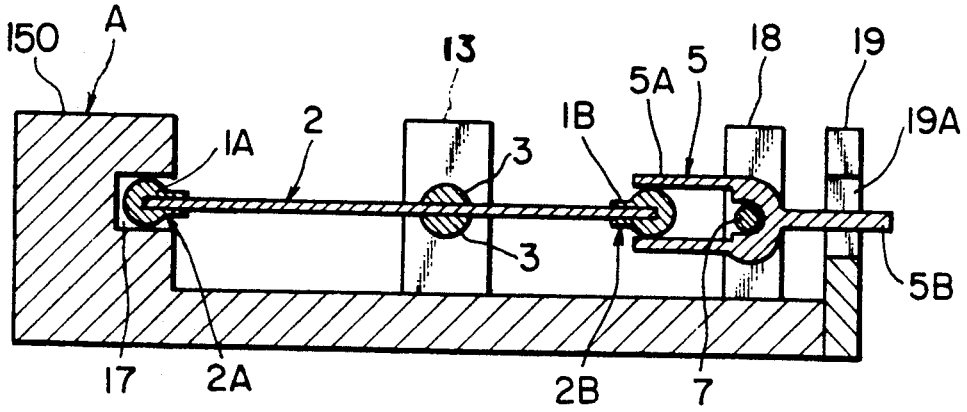
FIG. 2 is a vertical longitudinal sectional view showing the knitting needle driving mechanism shown in FIG. 1.
Figure 5A:
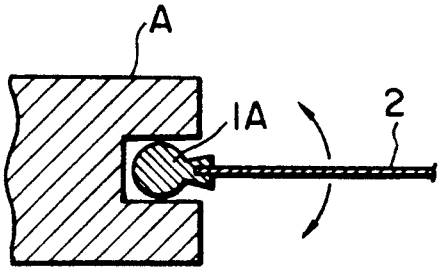
FIG. 5A is an enlarged sectional view showing an important portion of an embodiment according to the present invention.
Figure 5B:
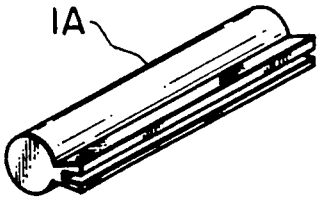
FIG. 5B is a perspective view showing a cylindrical member used in the present invention.

Referring to FIGS. 1 and 2, a cylindrical member 1A to which a rear end portion 2A of a piezo-electric body 2 is attached is inserted into a groove 17 formed on a piezo-electric body supporting portion 150 of a supporting body A. The perspective view of the cylindrical member 1A is shown in FIG. 5B. The cylindrical member 1A is axially provided with a slot, into which the rear end portion of the piezo-electric body 2 is inserted and fixed. Since the cylindrical member 1A is rotatable in the groove 17 of the supporting body A as shown in FIG. 5A, the rear end portion 2A of the piezo-electric body 2 is movable upward or downward as indicated by the arrows in FIG. 5A.

Figure 7A:
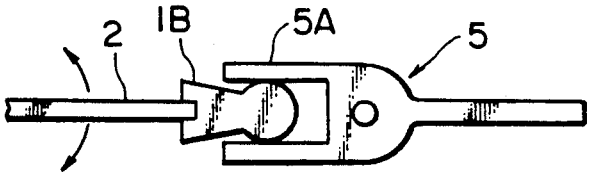
FIG. 7A is a side elevation view showing an important portion of an embodiment according to the present invention.

A cylindrical member 1B similar to that described above is attached to a front end portion 2B of the piezo-electric body 2. The cylindrical member 1B is rotatably inserted for connection in an open end portion of a rear end portion 5A of a finger 5. As shown in FIG. 7A, therefore, the front end portion 2B of the piezo-electric body 2 is movable upward or downward as indicated by the arrows.

Figure 7B:
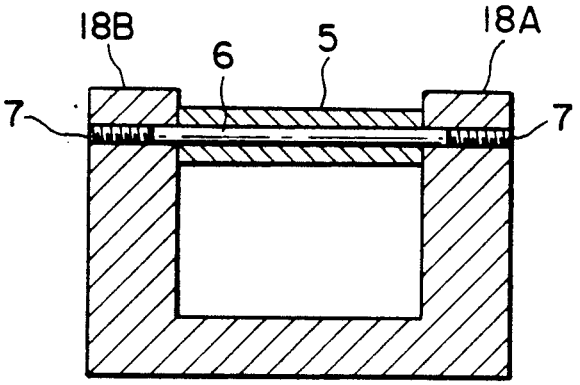
FIG. 7B is a sectional view showing an important portion of an embodiment according to the present invention.

The rear end portion 5A of the finger 5 is provided with a hole in the crosswise direction of the finger 5, and each of right and left end walls 18A and 18B of a finger fixing portion 18 of the supporting body A is also provided with a hole. As shown in FIG. 7B, a shaft 6 is inserted into the hole of the finger 5, and both ends of the shaft 6 are fitted into the holes of the right and left end walls 18A and 18B, respectively. Then, screws 7 and 7 are threaded in both the ends of the shaft 6 to fix the shaft 6 to the end walls 18A and 18B.

Figure 7C:
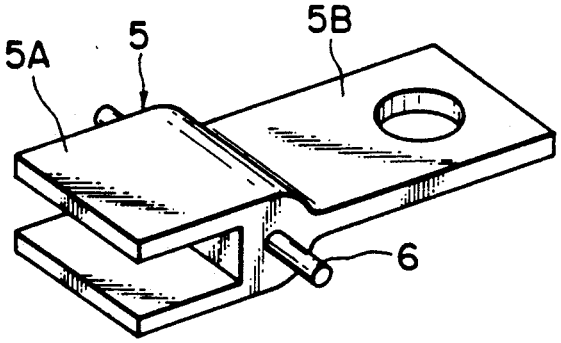
FIG. 7C is a perspective view showing another finger used in the present invention.

As shown in FIG. 7C, shafts 6 may be securely attached to both sides of the rear end portion 5A of the finger 5, and respective ends of the shafts 6 may be inserted into holes of the side walls 18A and 18B. In this case, each end of the shafts 6 is threaded, whereas each of the holes of the side walls 18A and 18B is also provided with an internal thread.

The strip-like finger 5 is connected to the rectangular piezo-electric body 2 in alignment (in the same direction). The finger 5 is formed as short as possible. A front end portion 5B of the finger 5 is protruded through an opening 19A of an opening wall 19 of the supporting body A which is vertically installed apart from the finger fixing portion 18. The opening 19A has a size corresponding to the up-and-down movement of the finger 5.

The finger 5 engages with or disengages from a butt (finger butt) of a knitting needle or of a needle driving jack disposed in engagement with a lower end of the knitting needle, following the bending motion of a plate 8 due to a peizo-electric element. The front end portion 5B of the finger 5 engages with the above butt.

Figure 6A:
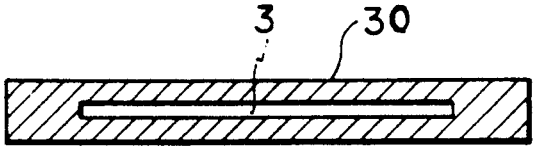
FIG. 6A is a sectional view showing a rotatable member used in the present invention.
Figure 6B:
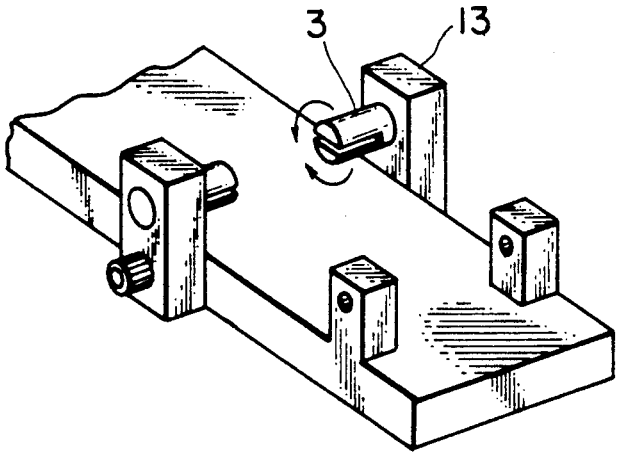
FIG. 6B is a perspective view showing an important portion of an embodiment according to the present invention.

An intermediate portion between the rear end portion 2A and the front end portion 2B of the piezo-electric body 2 is inserted into a rotatable member mounted on an intermediate supporting portion 13 of the supporting body A. The rotatable member 3 is provided with a through slot 30 having a size of such a degree that the piezo-electric body 2 can be inserted therein. The piezo-electric body 2 is inserted into the through slot 30 of the rotatable member 3, thereby supporting the piezo-electric body 2. Both ends of the rotatable member 3 are rotatably supported by means of screws inserted into holes formed in the intermediate supporting portion 13. It is preferable that the piezo-electric body 2 is securely fixed to an inner surface of the through slot 30 of the rotatable member 3 with an adhesive or the like. However, the piezo-electric body 2 may only be supported without being securely fixed. In any case, the rotatable member 3 is rotatable as shown in FIG. 6B on which description will be made later on.

An intermediate portion Y is important which is situated between the front end portion 2B and the rear end portion 2A of the piezo-electric body 2 and where the piezo-electric body 2 is supported by its insertion into the rotatable member 3 as described above. This portion serves as a fulcrum of the bending motion of the piezo-electric body 2. As shown in FIG. 8B(A), the finger 5 is increased in speed and torque, and decreased in amplitude (X), thereby being capable of reducing applied voltage, as this portion Y approaches the finger 5. However, when the portion Y approaches the finger 5 too near, the torque is reduced. On the other hand, when the portion Y goes away from the finger 5, a reverse phenomenon takes place, as shown in FIG. 8B. In this case, the amplitude (X) is increased and the torque is decreased. It is therefore necessary to select a suitable position for the portion Y, and hence it is preferable that the portion Y is constituted so that a suitable position can be selected.

Another embodiment of the present invention will hereinafter be described referring to FIGS. 3 and 4.

Figure 5C:
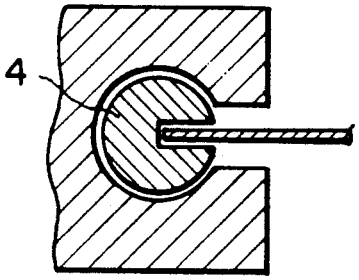
FIGS. 5C to 5E are enlarged sectional view showing important portions of embodiments according to the present invention.
Figure 5D:
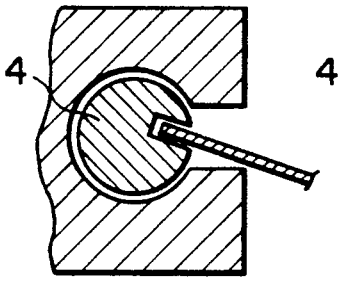
Figure 5E:
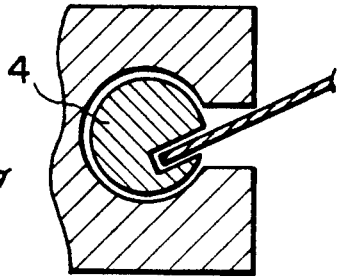
Figure 5F:
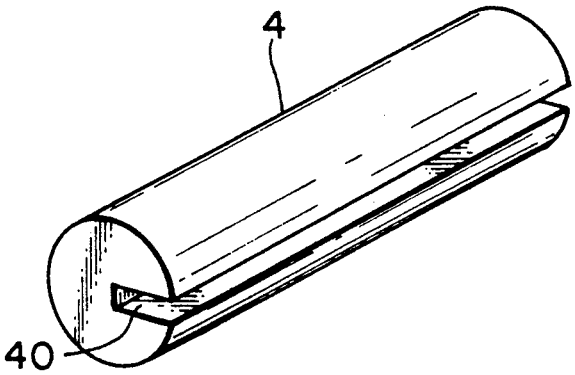
FIG. 5F is a perspective view showing a rod used in the present invention.

In this embodiment, a rod 4 having a slit portion 40 as shown in FIG. 5F is inserted into the groove 17 formed on the piezo-electric body supporting portion 150 of the supporting body A. Before voltage is applied to the piezo-electric element 9, the slit portion 40 of the rod 4 is parallel to the piezo-electric element 2, as shown in FIG. 5C. However, when voltage is applied, the piezo-electric body 2 executes the bending motion, and at that time the rod 4 rotates to turn the piezo-electric body 2 downward as shown FIG. 5D or upward as shown in FIG. 5E.

Figure 4:
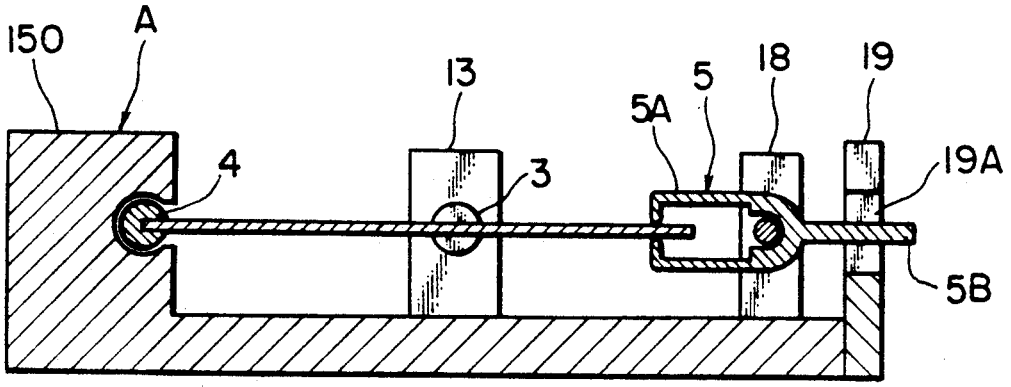
FIG. 4 is a vertical longitudinal sectional view showing the knitting needle driving mechanism shown in FIG. 3.
Figure 7D:
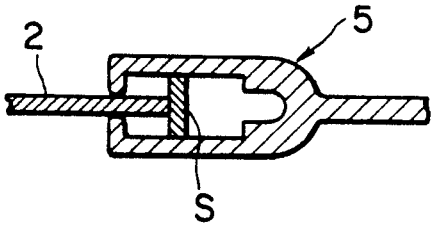
FIG. 7D is a sectional view showing still another finger used in the present invention.

In this embodiment, it is not adopted that the cylindrical member 1B is attached to the front end portion 2B of the piezo-electric body 2 as in the above embodiment, but the front end portion 2B of the piezo-electric body 2 is supported between vertically protruded ends of the rear end portion 5A of the finger 5 as shown in FIG. 4. It is preferable to mount a stopper S in the rear end portion 5A of the finger 5 as shown in FIG. 7D to prevent the rear end portion 2B of the piezo-electric body 2 from moving to the right in the drawing. It is also preferable in the above embodiment to mount a stopper S similarly to prevent the rear end portion 2B of the piezo-electric body 2 from moving to the right.

Figure 6C:
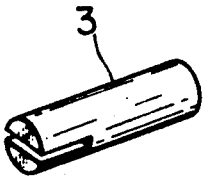
FIG. 6C is a perspective view showing a rotatable member used in the present invention.
Figure 6D:
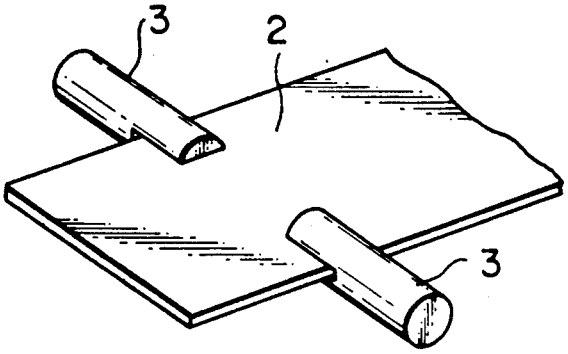
FIG. 6D is a perspective view showing an important portion of an embodiment according to the present invention.

Further, a rotatable member 3 used in this embodiment is shown in FIG. 6C. An end of the rotatable member 3 is provided with a notch. The other end of the rotatable member 3 is rotatably attached to the intermediate supporting portion 13 by means of a screw threaded into a hole formed in the intermediate supporting portion 13. As illustrated in FIGS. 6B and 6D, both side portions of the piezo-electric body 2 are inserted into the respective notches of the rotatable members 3 and 3 on both sides rotatably attached to the intermediate supporting portion 13. It is preferable that both side portions of the piezo-electric body 2 is securely fixed to an inner surface of each notch of the rotatable member 3 with an adhesive or the like. However, the piezo-electric body 2 may only be supported without being securely fixed. In any case, the rotatable member 3 is rotatable as shown in FIG. 6B.

Figure 3:
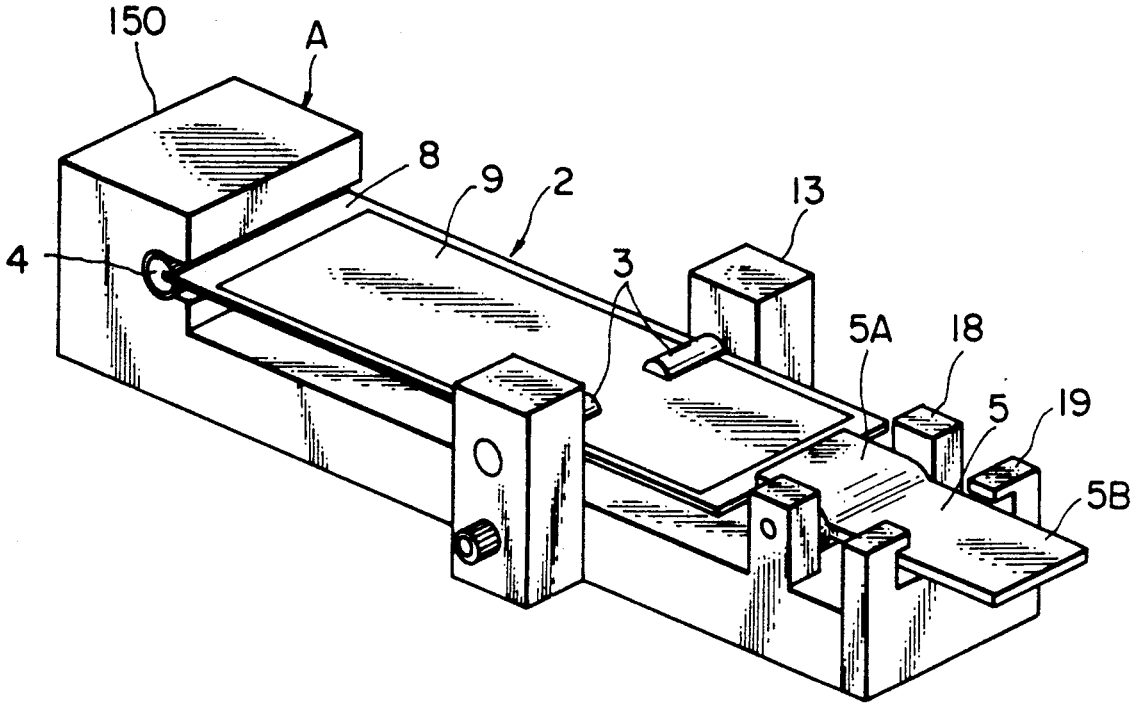
FIG. 3 is a perspective view showing another knitting needle driving mechanism embodying the present invention.
Figure 8A:
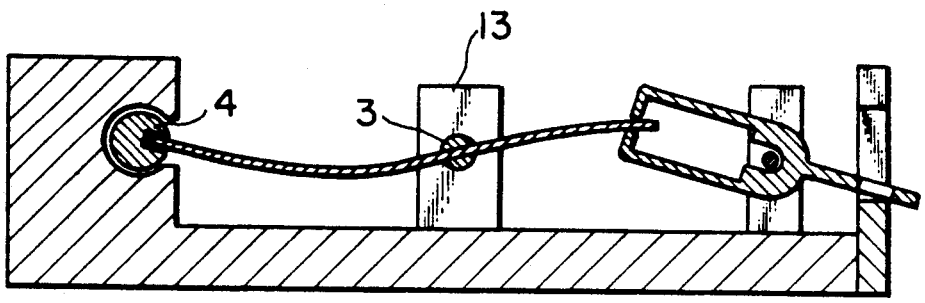
FIG. 8A is a sectional view showing an embodiment of the present invention.
Figure 8B:
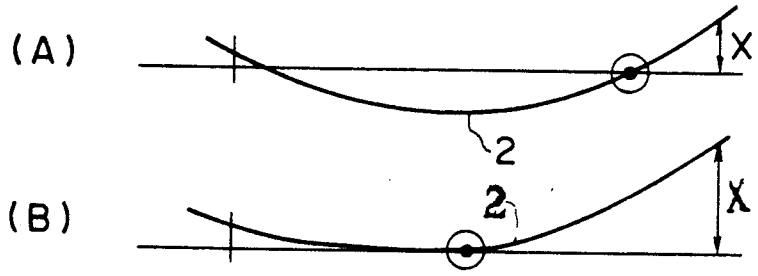
FIG. 8B is a diagrammatic view illustrating operation of a knitting needle driving mechanism according to the present invention.
Figure 9:
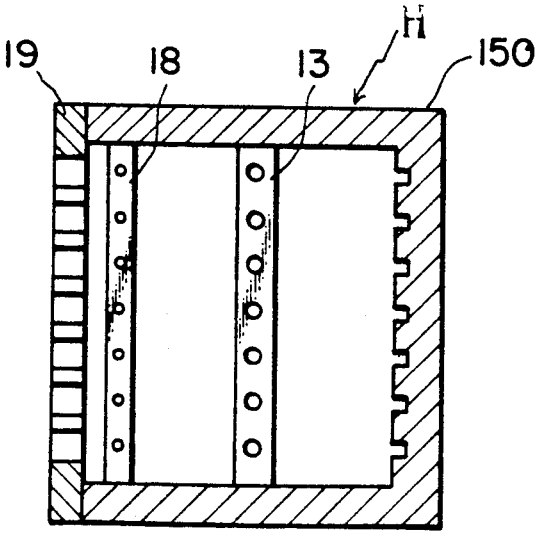
FIG. 9 is a sectional view showing a housing used in the present invention.
Figure 10A:
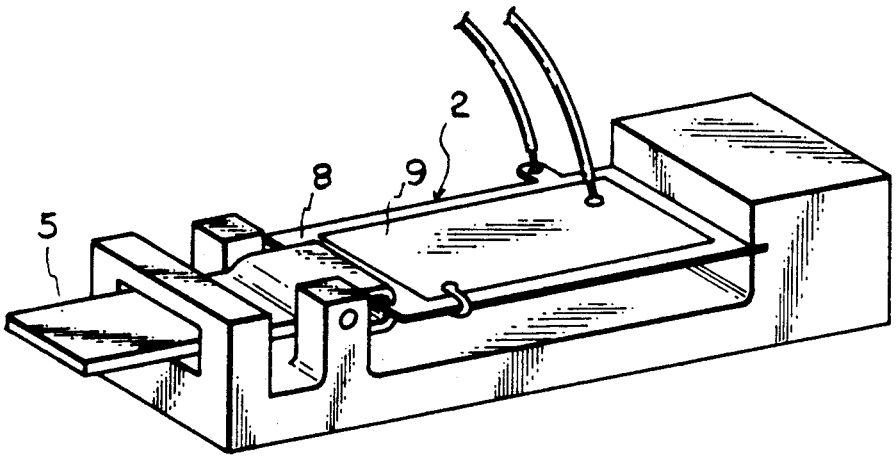
FIG. 10A is a perspective view showing a knitting needle driving mechanism proposed in the course of completing the present invention.
Figure 10B:
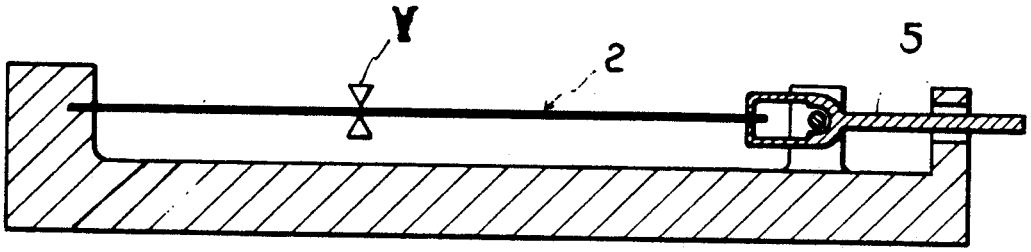
FIG. 10B is a sectional view of the knitting needle driving mechanism shown in FIG. 10A.

As an example, there is schematically shown in FIG. 8A a locus of the bending motion of the piezo-electric body 2 with respect to the knitting needle driving mechanism shown in FIG. 3.

The piezo-electric body 2 used in the present invention comprises a plate 8 and a piezo-electric element (piezo-electric sheet) 9 attached thereto. For the above piezo-electric body 2, a cavity portion (space portion) is formed on the plate 8 and the piezo-electric element 9 is bonded in this cavity portion. Such formation of the cavity portion can reduce the weight of the plate 8, which results in easy bending of the plate 8. Accordingly, when voltage (pulse) is applied to the piezo-electric element 9, the plate 8 can be easily bent by low voltage.

The piezo-electric element 9 is, for example, bonded to the plate 8 by using an adhesive such as an epoxy adhesive. When the piezo-electric element 9 is bonded to the plate 8 by using the adhesive, the above cavity portion causes the bonding to be surely performed. The cavity portion is preferably formed on both the upper and lower faces of the plates, but may be formed on either face. However, it is preferably to attach the piezo-electric elements to both faces, because voltage to be applied to the piezo-electric element can be reduced to one-half. Each plus electrode and each minus electrode of two piezo-electric elements must be arranged in the same direction when the piezo-electric elements are bonded to both faces.

Figure 11:
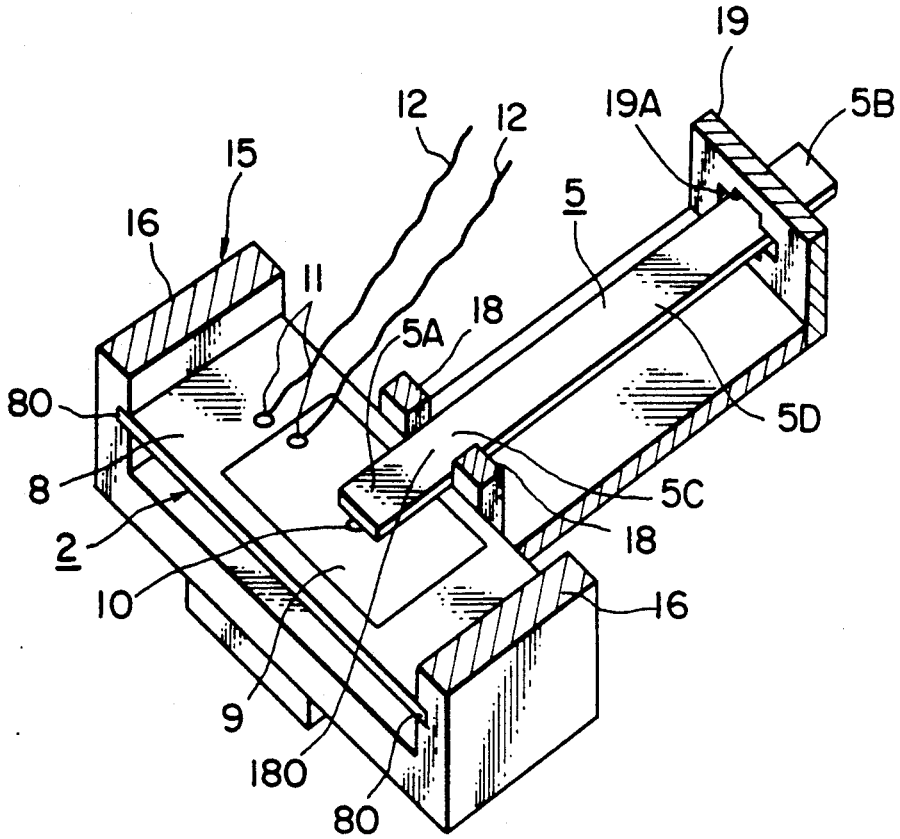
FIG. 11 PRIOR ART
FIG. 11 is a perspective view showing a prior-art knitting needle driving mechanism.
Figure 13:
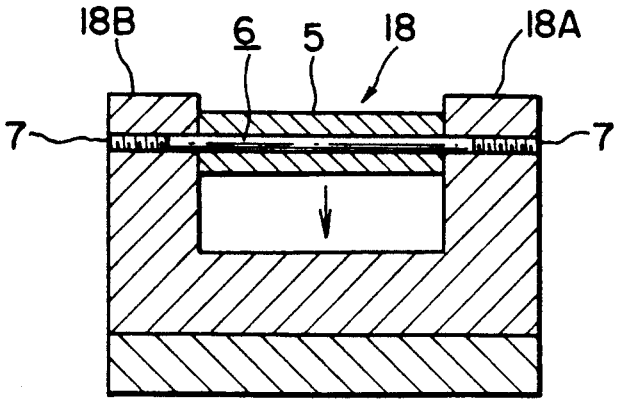
FIG. 13 PRIOR ART
FIG. 13 is a sectional view showing a finger fixing portion used in a prior-art knitting needle driving mechanism.
Figure 19:
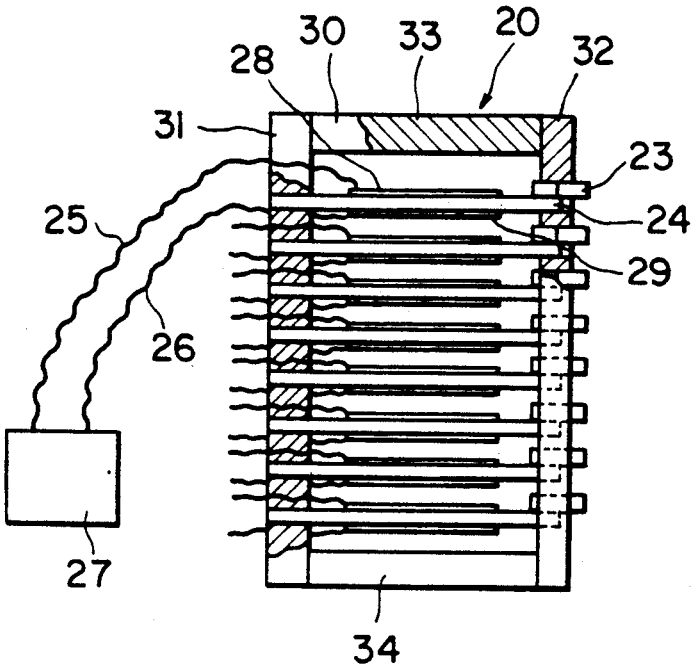
FIG. 19 PRIOR ART
FIG. 19 is a partially sectional front view of a prior-art knitting needle driving mechanism.
Figure 20:
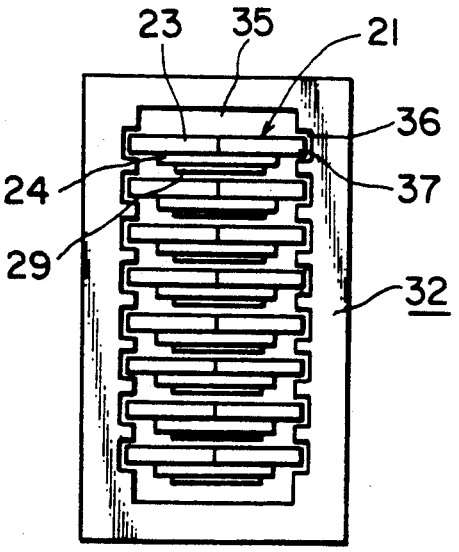
FIG. 20 PRIOR ART
FIG. 20 is a side elevation view of the knitting needle driving mechanism shown in FIG. 19.
Figure 21:
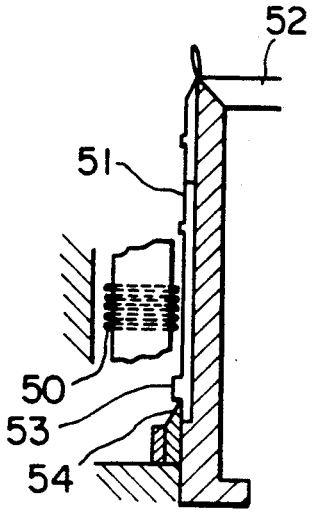
FIG. 21 PRIOR ART
FIG. 21 is a partially sectional side elevation view illustrating a prior-art knitting needle driving mechanism.

As the piezo-electric element 9, any kind of piezo-electric element may be used, as long as the element has an inverse piezo-electric effect. However, ceramic piezo-electric elements formed of barium titanate are preferably used, because the piezo-electric elements having stable qualities can be commercially provided in a large amount. The thinner the piezo-electric element is, the higher the electric field is elevated. It is therefore preferable to use the piezo-electric element having a thickness of about 100 to 200 microns and formed in a form elongated in the longitudinal direction of the plate 8. As shown in FIG. 11, paste for electrodes is baked on both faces of the piezo-electric element 9, and lead wires 12 and 12 are connected to the electrodes 11 and 11, respectively. The other ends of the lead wires 12 and 12 are connected to a controller 27 as shown in FIG. 19.

Since the piezo-electric element 9 is high in response speed, a pulse with high frequency can be applied thereto.

The above plate 8 is formed of, for example, a metal.

The finger 5 is formed of, for example, a metal, similarly with the plate 8. The finger 5 is formed so as to be a long narrow strip-like thin plate having a thickness of, for example, about 1 mm, but is not required to be uniform in thickness. The front end portion 5B of the finger 5 may be thicker than the other in order to cushion the impact produced by collision with the butt. The response speed of the finger 5 is increased with a decrease in thickness thereof. The finger 5 may be formed in a shape tapered from the rear end portion 5A thereof to the front end portion 5B thereof, whereby the weight of the finger 5 can be reduced and the response speed of the finger 5 can be more improved. Further, the finger 5 is preferably provided with a through hole as shown in FIG. 7C, for a reason similar to that described above.

Figure 12:
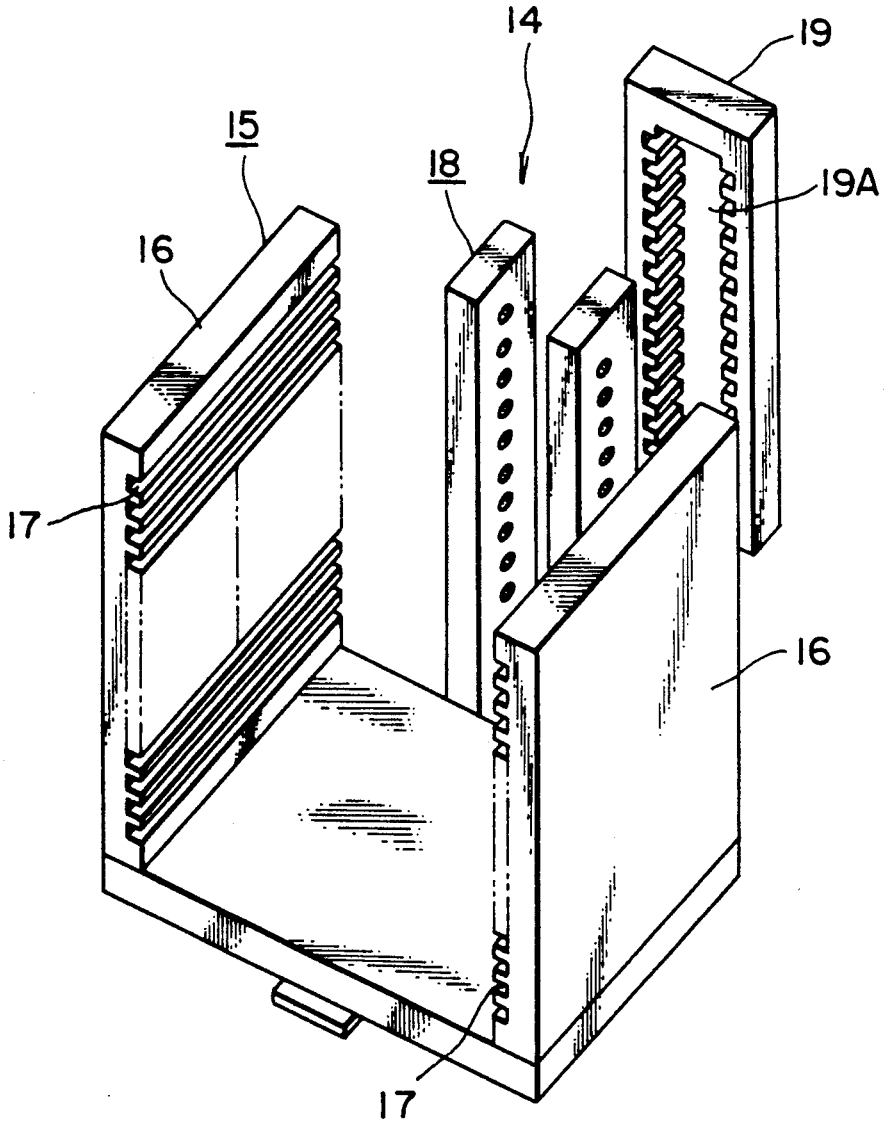
FIG. 12 PRIOR ART
FIG. 12 is a perspective view showing a housing used in a prior-art knitting needle driving mechanism.
Figure 14:
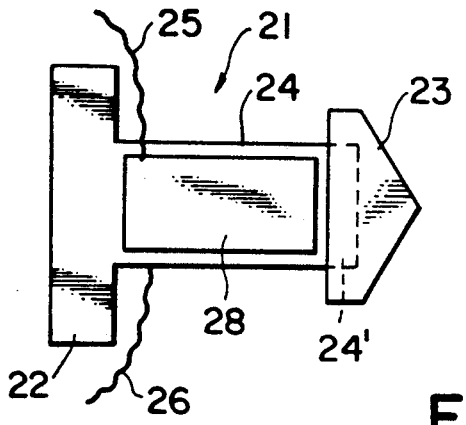
FIG. 14 PRIOR ART
FIG. 14 is a plan view showing a prior-art knitting needle driving mechanism.
Figure 15:
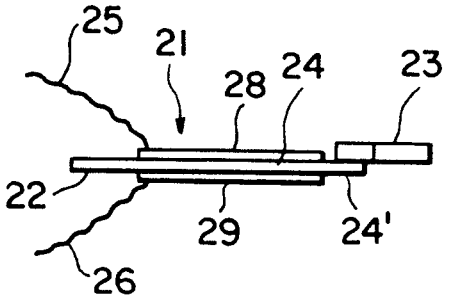
FIG. 15 PRIOR ART
FIG. 15 is a side elevation view of the knitting needle driving mechanism shown in FIG. 14.
Figure 16:
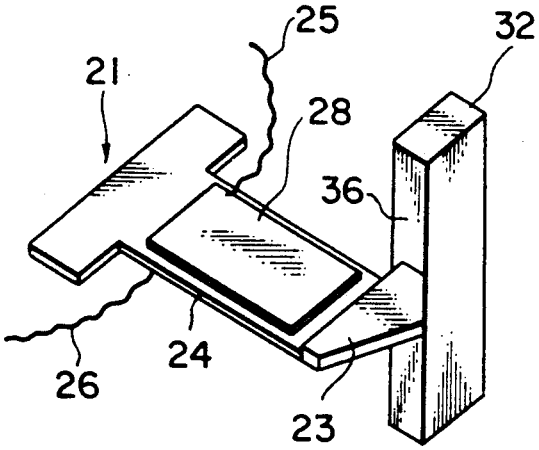
FIG. 16 PRIOR ART
FIG. 16 is a perspective view of the knitting needle driving mechanism shown in FIG. 14.
Figure 17:
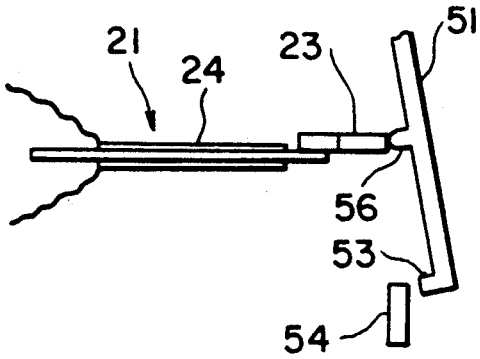
FIG. 17 PRIOR ART
FIGS. 17 and 18 are side elevation views illustrating operation of the knitting needle driving mechanism shown in FIG. 14.
Figure 18:
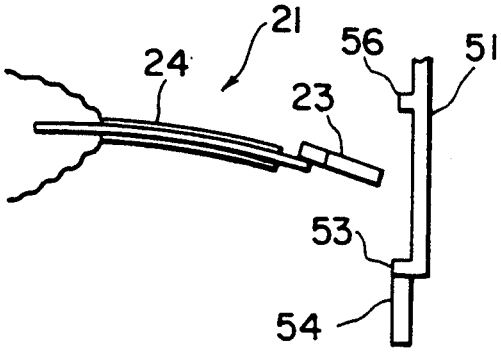
FIG. 18 PRIOR ART

In the embodiments described above, one piezo-electric body 2 and one finger 5 are incorporated in the supporting body A to constitute a cartridge-type knitting needle driving mechanism as shown in FIGS. 1 and 3. A suitable number of cartridge-type knitting needle driving mechanisms are accommodated in the housing by placing the mechanisms on partition shelves of the housing, respectively, thereby knitting a fabric. However, the piezo-electric element 2 and the finger 5 may be incorporated in the housing constructed for the knitting needle driving mechanisms as shown in FIG. 12. The housing is shown in FIG. 19, in which the marks correspond to those in FIG. 1. The piezo-electric bodies 2 and the fingers 5 are accommodated in the housing H in a multistage manner. When the knitting needle driving mechanism is actuated, the knitting needle driving mechanism is accommodated in the housing as described above, and then a pulse is applied from the controller 27 electrically connected with the lead wires to each piezo-electric element 9.

The controller 27 is a device for memorizing a pattern procedure and applying a pulse to a plurality of piezo-electric elements on the basis of the memorized pattern procedure. Such a device is well known in the art, and therefore a further detailed description thereof will be omitted. Thus, each plate 8 is bent around the intermediate fulcrum on the basis of the pulse applied from the controller 27, and each finger 5 moves upward or downward based on the pattern procedure memorized in the above controller 27.

Although the invention has been described in its preferred embodiments, it is understood of course that these embodiments are not intended to limit the scope of the invention and that various changes and modifications may be made in the invention without departing from the spirit and scope thereof.

The knitting needle driving mechanism according to the present invention can be applied to various kinds of knitting machines.

In a circular knitting machine, a needle bed, namely a knitting cylinder, is rotated against a frame of the circular knitting machine, and the knitting needle driving mechanism is fixed to the frame of the knitting machine. Hence, when the knitting needle driving mechanism according to the present invention is used in the circular knitting machine, it is necessary to constitute the knitting needle driving mechanism in such a manner that each finger of the knitting needle driving mechanism fixed to the frame engages with a finger butt of a knitting needle or a lower end of the knitting needle of the rotating knitting cylinder on actuation of the finger.

On the other hand, the knitting needle driving mechanism according to the present invention can also be used in a flat knitting machine. In the flat knitting machine, a needle bed is fixed to a frame of the flat knitting machine, and a slider comprising the knitting needle driving mechanism and a yarn feed device slide along the needle bed, thereby knitting a jacquard fabric. It is therefore required to constitute the knitting needle driving mechanism in such a manner that a end portion of a finger of the knitting needle driving mechanism is actuated to engage with a finger butt of a knitting needle of the fixed needle bed or a finger butt of a jack engaging with a lower end of the knitting needle when the slider slides.

I claim:

1. A knitting needle driving mechanism for a knitting machine having a piezo-electric body composed of a plate and a piezo-electric element bonded thereto and a finger attached to said piezo-electric body, in which it is enabled to knit a predetermined pattern by applying voltage to said piezo-electric element to actuate said finger and thereby driving a knitting needle of the knitting machine, the improvement comprising a rear end portion of said piezo-electric body is movably supported in a groove of a supporting body or a housing, a front end portion of said piezo-electric body is movalby connected to a rear end portion of said finger which is arranged so as to be aligned with said piezo-electric body and supported at the rear end portion thereof by the supporting body or the housing, and an intermediate portion between the front end portion and the rear end portion of said piezo-electric body is inserted into a rotatable member rotatably mounted on the supporting body or the housing.

2. A knitting needle driving mechanism according to claim 1, in which a cylindrical member is attached to the rear end portion of said piezo-electric body, and said cylindrical member is inserted into said groove of said supporting body or said housing.

3. A knitting needle driving mechanism according to claim 1, in which a rod having a slit portion is rotatably inserted into said groove of said supporting body or said housing, and the rear end portion of said piezo-electric body is inserted into said slit portion of the rod.

4. A knitting needle driving mechanism according to claim 1, in which a cylindrical member is attached to the front end portion of said piezo-electric body, and said cylindrical body is inserted into the rear end portion of the finger.

* * * * *